US005947329A

United States Patent [19]

Bailey

[11] Patent Number: 5,947,329

[45] Date of Patent: Sep. 7, 1999

[54] MEDICINE DISPENSER

[76] Inventor: Nelson E. Bailey, 10 Tee St., Selinsgrove, Pa. 17870

[21] Appl. No.: 09/074,395

[22] Filed: May 7, 1998

[51] Int. Cl.[6] ..... G07F 11/00

[52] U.S. Cl. ..... 221/288; 221/92; 222/454

[58] Field of Search ..... 221/266, 288, 221/92; 222/454, 456, 425, 455

[56] References Cited

U.S. PATENT DOCUMENTS

| | | | |
|---|---|---|---|
| 3,367,484 | 2/1968 | Nelson . | |
| 3,398,857 | 8/1968 | Alio . | |
| 3,424,355 | 1/1969 | Blumen . | |
| 4,078,687 | 3/1978 | Zapp . | |
| 4,117,956 | 10/1978 | Von Shuckman | 221/288 |
| 4,364,492 | 12/1982 | Kong . | |
| 4,805,811 | 2/1989 | Wetterlin . | |
| 5,114,029 | 5/1992 | Gibilisco . | |
| 5,186,366 | 2/1993 | Meisner et al. . | |
| 5,305,706 | 4/1994 | Arjomand | 116/234 |
| 5,769,268 | 6/1998 | Kuzma et al. | 220/780 X |

*Primary Examiner*—William E. Terrell
*Assistant Examiner*—Gene O Crawford
*Attorney, Agent, or Firm*—John J. Elnitski, Jr.

[57] ABSTRACT

The present invention is a medicine dispenser with sealed caps to prevent access of the contents to children. The medicine dispenser provides a challenge for children to gain access to the contents, while allowing relatively easy access to adults. The medicine dispenser is such that it requires specific and deliberate steps to allow an adult to access to the contents. These deliberate steps act to deter children from having easy access to the contents of the medicine dispenser. The term pill will be used through out this specification and represents pills, capsules, caplets or other forms of medicine which could be the contents of a medicine bottle.

19 Claims, 6 Drawing Sheets

MEDICINE DISPENSER

BACKGROUND

There are many child resistant bottles and caps on the market for dispensing medicine in the form of pills, capsules or caplets. Most of the current child resistant bottles and caps are difficult to operate. People with disabilities or feeble hands have difficulty opening most child resistant bottles and caps. The difficulty of opening the current bottles and caps is due to the relatively large amount of force required to open the child-proof caps. Many of the safety devices associated with cap removal from a pill bottle requires the use of two hands, while exerting a fairly large amount of force.

It is an object of the present invention is to provide a sealed pill dispenser that is easy to use by adults, especially those with disabilities or are feeble handed.

Another object of the present invention is to provide a pill dispenser that aids in preventing children from having easy access to the contents of the pill dispenser.

SUMMARY

The present invention is an apparatus and a method for dispensing objects such as medicine pills. The apparatus is a dispenser. The dispenser is an open ended container that has a continuous wall having an open top end and an open bottom end. The wall includes a delivery opening near the bottom end. A sealing cap is rotatively fixed to and encloses the top end. A delivery cap is rotatively fixed to and encloses the bottom end. The delivery cap includes an exit window which aligns with the delivery opening of the wall by rotating the delivery cap on the container. There is a floor inside the container near the bottom end to prevent the objects inside the container from passing into the delivery cap. The dispenser also includes a delivery tube inside the container between the sealing cap and delivery cap, whereby the tube protrudes through the floor.

The method of the present invention for dispensing objects includes the following steps. Inverting the dispenser so that a top end of the dispenser with a sealing cap is lower than a bottom end of the dispenser with a delivery cap. Rotating the sealing cap so that at least one pill is captured by a cavity of the sealing cap. Rotating the sealing cap so the cavity of the sealing cap is aligned with a delivery tube. Inverting the dispenser, so that the bottom end is lower than the top end, where the inverting motion of this step allows the object to fall along the delivery tube toward the delivery cap due to gravity. Rotating the delivery cap to align a cavity of the delivery cap with the delivery tube, where the object is allowed to fall into the cavity of the delivery cap. Rotating and aligning the cavity of the delivery cap and hence an exit window of the delivery cap with a delivery opening in a wall of the dispenser. Tilting the dispenser so that the object in the cavity of the delivery cap passes through the exit window by way of the delivery opening.

DETAILED DESCRIPTION

Figure 3:
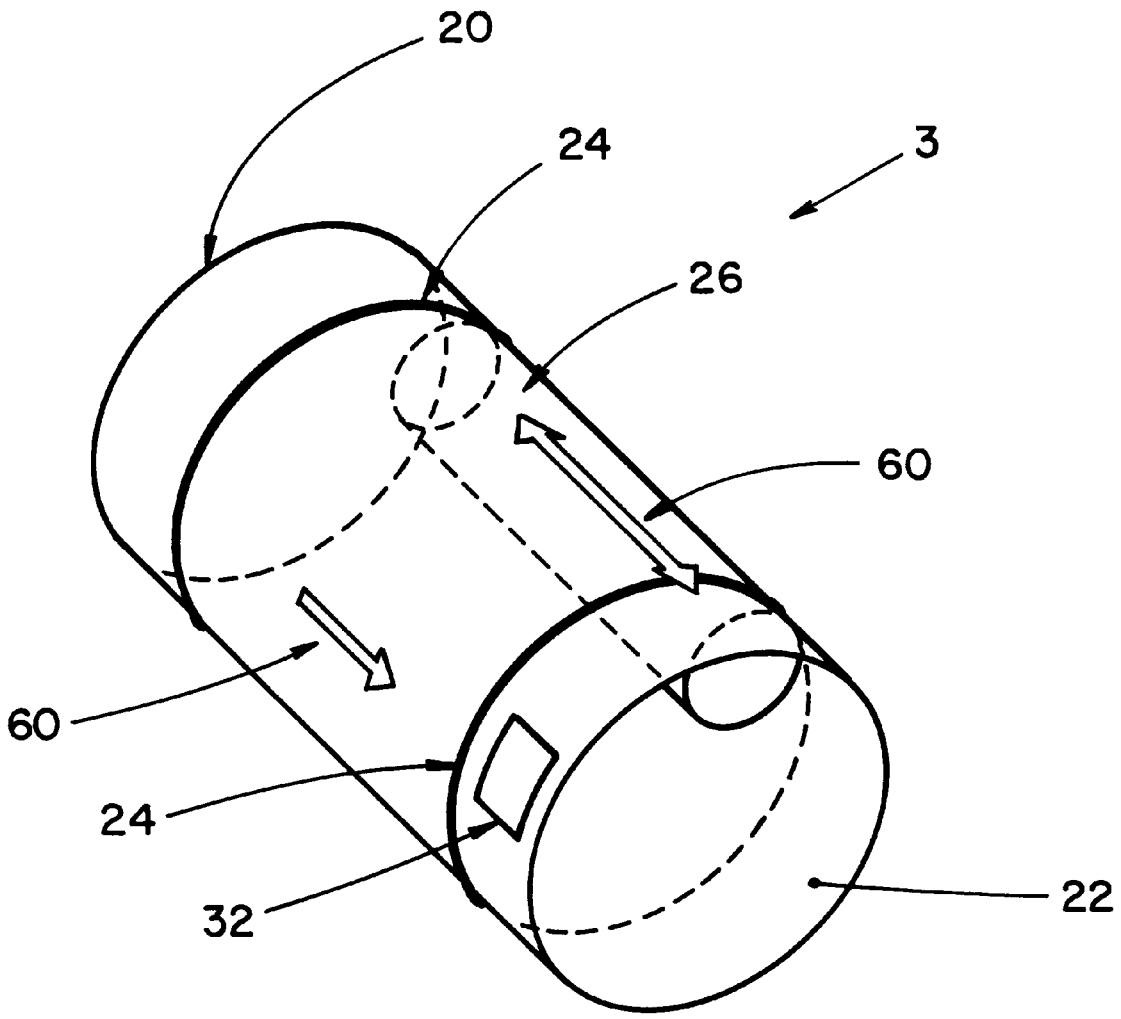
FIG. 3 is a perspective view of the medicine dispenser without the caps.

The present invention is a medicine dispenser with sealed caps to prevent access of the contents to children. The medicine dispenser provides a challenge for children to gain access to the contents, while allowing relatively easy access to adults. The medicine dispenser is such that it requires specific and deliberate steps to allow an adult to access to the contents. These deliberate steps act to deter children from having easy access to the contents of the medicine dispenser. The term pill will be used through out this specification and represents pills, capsules, caplets or other forms of medicine which could be the contents of a medicine bottle. As shown in FIGS. 1–6, the medicine dispenser 10 includes a pill reservoir 12, a sealing cap 14 and a delivery cap 16. The pill reservoir 12 includes a cylinder 18 having an open top end 20 and an open bottom end 22, as shown in FIG. 3. The top end 20 receives the sealing cap 14 and bottom end 22 receives the delivery cap 16. On the outside of the cylinder 18 at each end 20, 22 is a sealing collar 24. Each sealing collar 24 extends outwardly all the way around each of the cylinder ends 20, 22. A circular delivery tube 26 is positioned inside the cylinder 18. The delivery tube 26 is shorter in length than the cylinder 18 and is preferably a length that does not extend past the sealing collars 24. The delivery tube 26 can be formed as part of the inside surface 30 of the cylinder 18 or can be a separate item that is attached to the inside surface 30 of the cylinder 18. The pill reservoir 12 includes a delivery opening 32 at the bottom end 22. The delivery opening 32 provides an opening in the wall of the cylinder 18 for passage of a pill 34. Also, included in the pill reservoir 12 is a floor 36 which is between the delivery opening 32 and the top end 20, whereby the delivery tube 26 protrudes through the floor 36.

Figure 4:
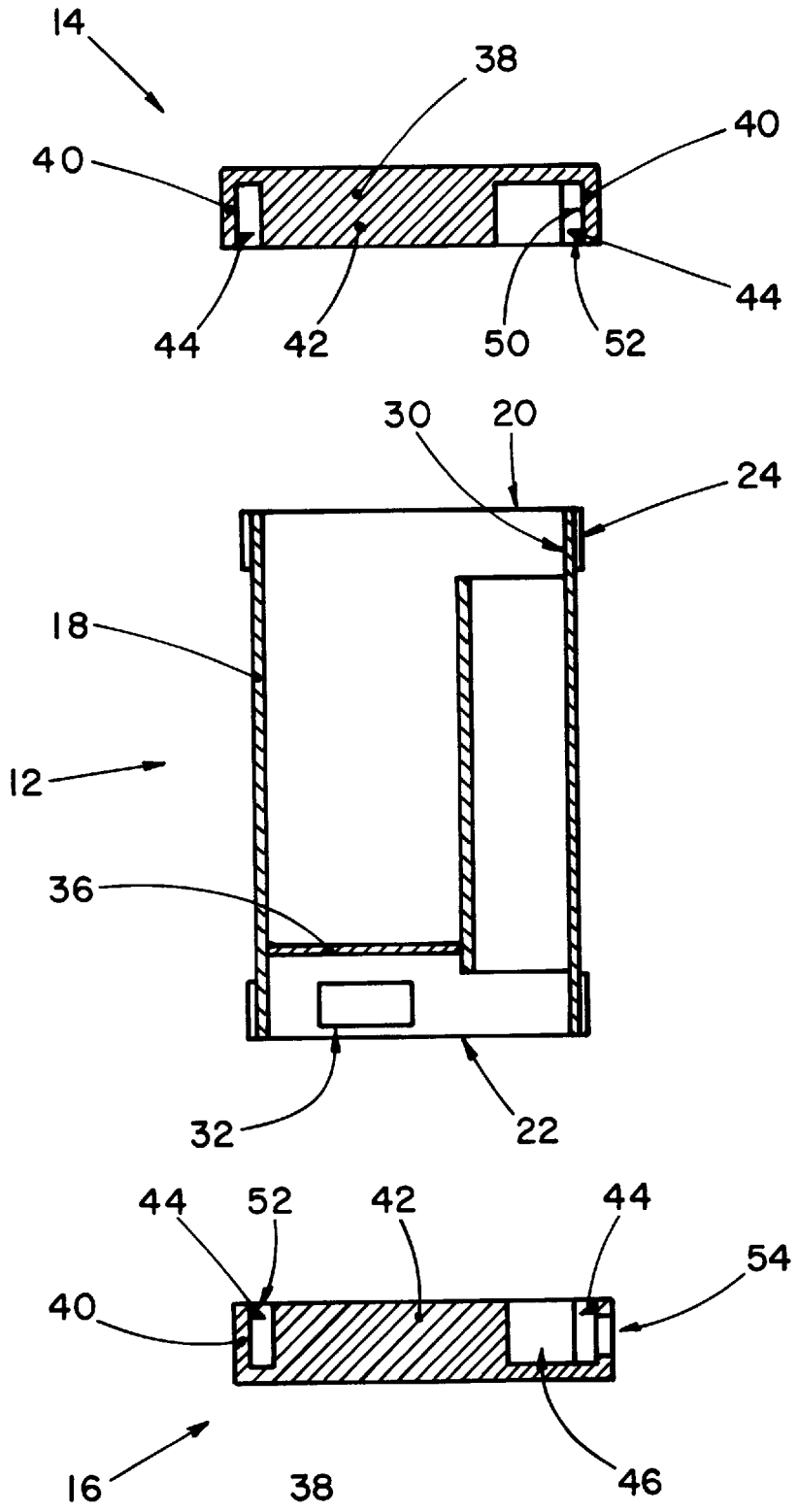
FIG. 4 is a cross-sectional exploded view of the dispenser of FIG. 1.
Figure 5:
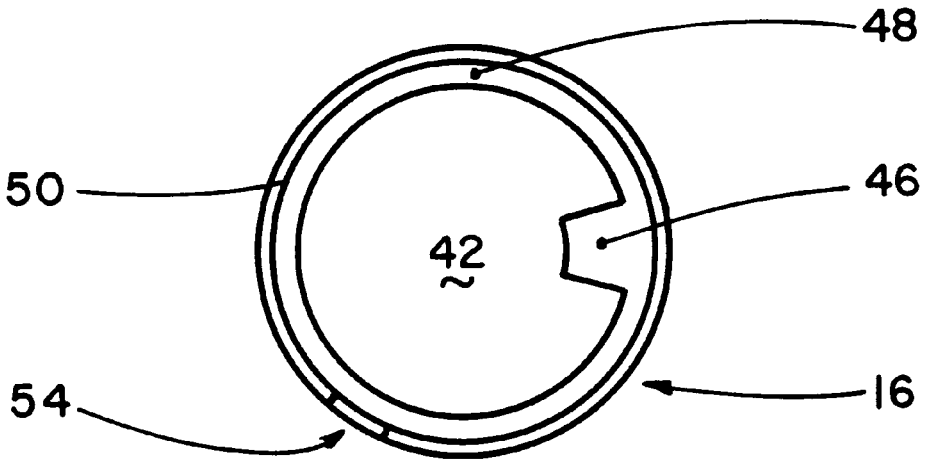
FIG. 5 is a bottom view of the delivery cap according to the present invention.

The sealing and delivery caps 14, 16 are of a sufficient depth to accommodate a pill 34. Each cap 14, 16 includes a top 38, outside flange 40, sealing center 42 and a sealing flange 44. It is preferable to have the caps 14, 16 made or formed into one piece. The outside flange 40 extends about and downward from the top 38. The inside center of each cap 14, 16 is occupied by the sealing center 42. Each sealing center 42 includes a pill cavity 46 to accommodate a pill 34. The area 48 formed between the sealing center 42 and outside flange 40 is large enough to receive the sealing collars 24 and allow rotation of the caps 14, 16 when the caps 14, 16 are placed on the ends 20, 22 of the pill reservoir 12. The sealing flange 44 runs all the way around the bottom inside surface 50 of the outside flange 40 and extends towards the sealing center 42. The sealing flange 44 snaps over the sealing collar 24 to permanently retain the caps 14, 16 on the pill reservoir 12. The sealing flange 44 is of a triangular shape as shown in FIG. 4. The sloping leg 52 of the triangular shape allows the sealing flange 44 to slide or snap more easily over the sealing collar 24 during assembly of medicine dispenser 10. The delivery cap 16 also includes a exit window 54 which is aligned with the pill cavity 46 to allow passage of a pill 34.

Assembly of the medicine dispenser 10 is as follows. The delivery cap 16 is snapped onto the bottom end 22 of the pill reservoir 12. The medicine in the form of pills 34 is loaded into the pill reservoir 12 through the open top end 20. The floor 36 supports the pills 34 and prevents the pills 34 from entering the pill cavity 46 of the delivery cap 16. The floor 36 also prevents the pills 34 from entering the delivery tube 26 at the bottom end 22. Finally, the sealing cap 14 is snapped onto the top end 20 of the pill reservoir 12. The assembly of the medicine dispenser 10 can be performed at the facility where the pills are manufactured or by a pharmacist at a drug store who is filling a prescription.

The procedure for dispensing pills 34 from the medicine dispenser 10 is as follows. Dispensing of a pill 34 from the medicine dispenser 10 requires several deliberate steps. The first step is to invert the medicine dispenser 10 so that the top end 20 with the sealing cap 14 is lower than the bottom end 22 with the delivery cap 16. The second step is to rotate the sealing cap 14 so that a pill 34 is captured by the pill cavity 46 of the sealing cap 14. The third step is to rotate the sealing cap 14 so the pill cavity 46 is aligned with the delivery tube 26. The fourth step is to invert the medicine dispenser 10, so that the bottom end 22 is lower than the top end 20. The inverting motion of the medicine dispenser 10 allows the pill 34 to fall along the delivery tube 26 toward the delivery cap 16 due to gravity. The fifth step is to rotate the delivery cap 16 and align the pill cavity 46 of the delivery cap 16 with the delivery tube 26. This allows the pill 34 to fall into the pill cavity 46 of the delivery cap 16. The sixth step is to rotate and align the pill cavity 46 and hence the exit window 54 of the delivery cap 16 with the delivery opening 32 of the pill reservoir 12. The final step is to tilt the medicine dispenser 10 so that the pill 34 in the pill cavity 46 passes through the exit window 54 via the delivery opening 32.

Figure 1:
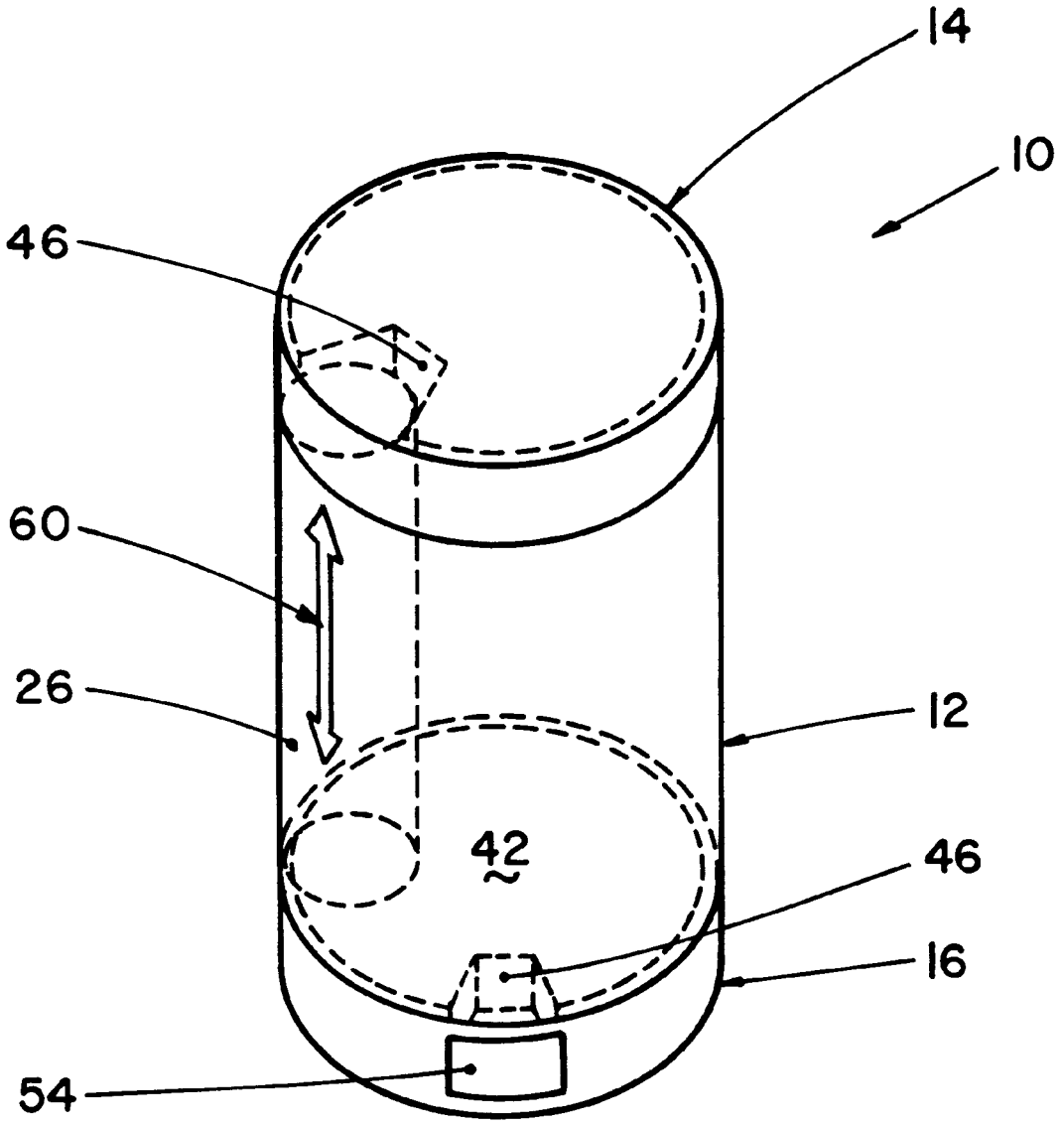
FIG. 1 is a perspective view of the medicine dispenser according to the present invention.
Figure 2:
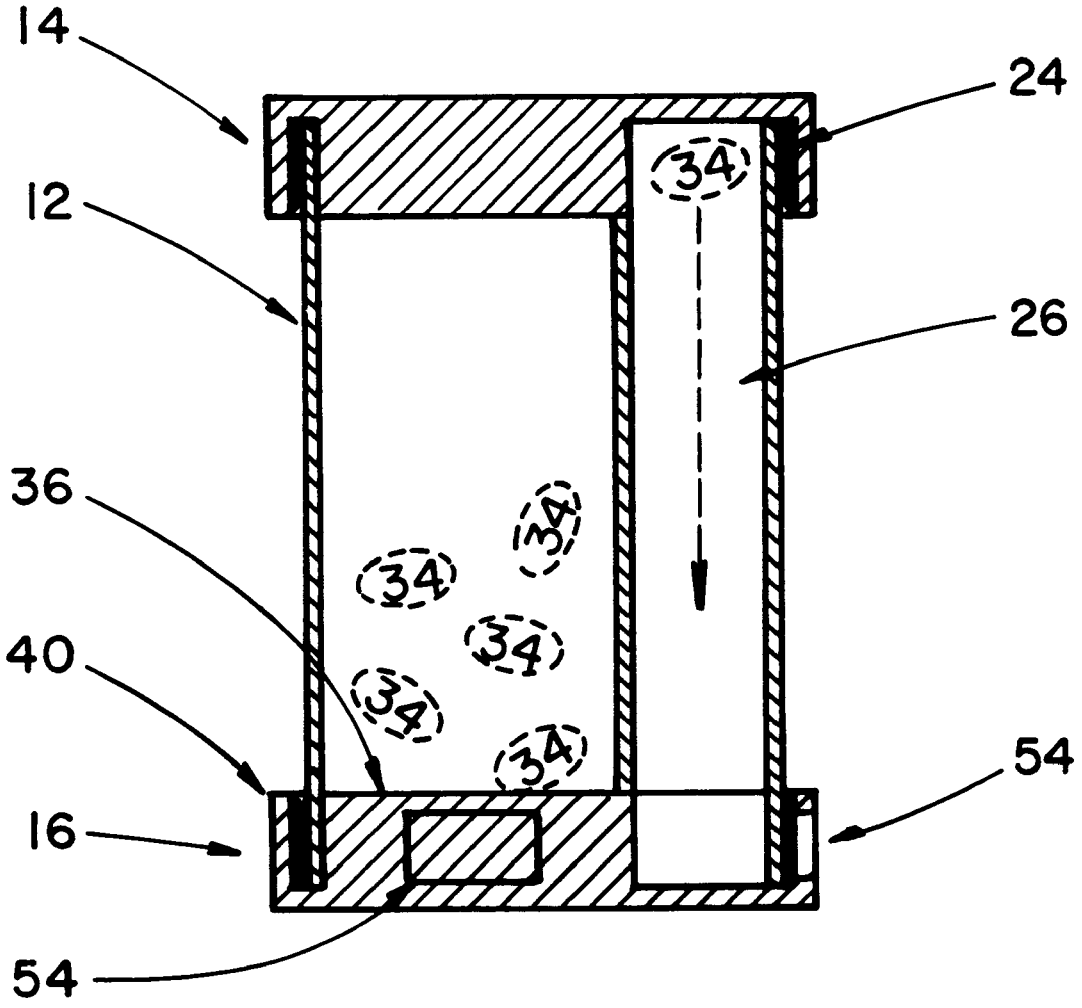
FIG. 2 is a cross-sectional view of the dispenser of FIG. 1.
Figure 6:
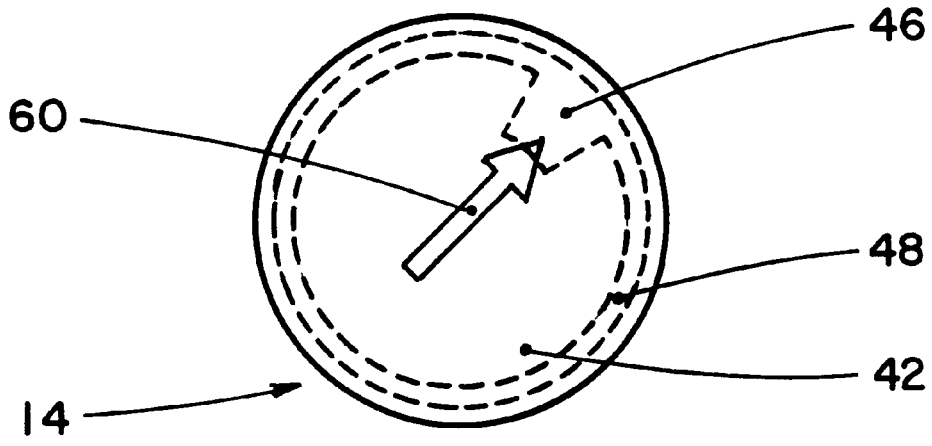
FIG. 6 is a top view of the sealing cap according to the present invention.
Figure 7:
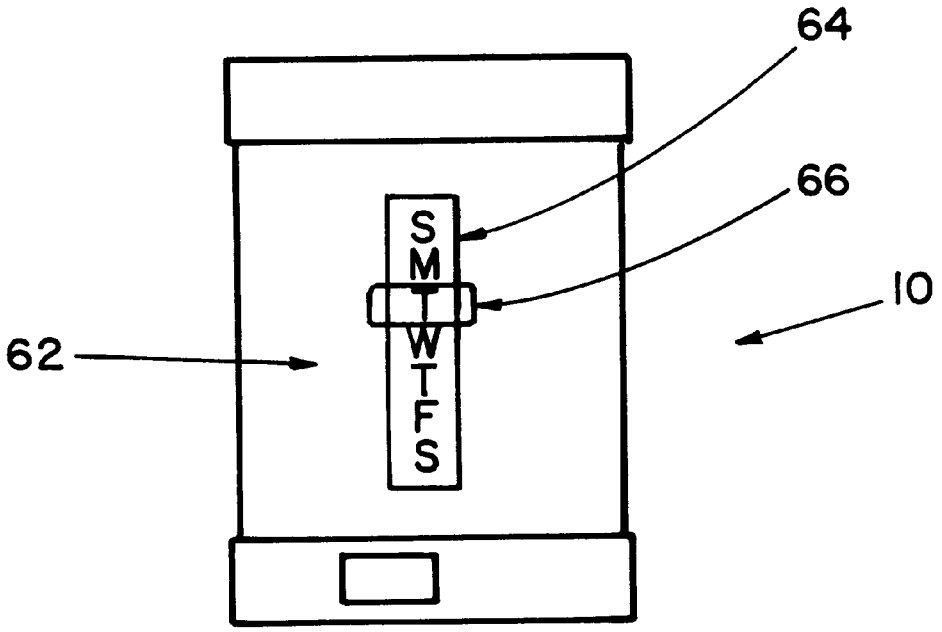
FIG. 7 is a side view of the medicine dispenser of FIG. 1 with a sliding marker according to the present invention.
Figure 8:
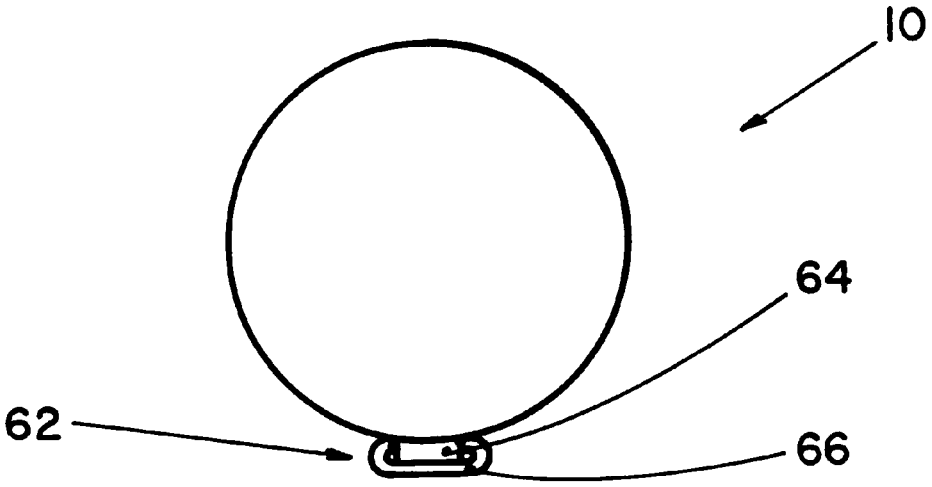
FIG. 8 is a top view of the sliding marker of FIG. 7.

Additional features of the medicine dispenser 10 are as follows. Indicators 60 as shown in FIGS. 1, 3, 6 allow an easy reference for aligning the pill cavities 46 with the delivery tube 26 and the delivery opening 32. A sliding marker 62 as shown in FIGS. 7–8 allows the user of the medicine dispenser 10 to mark the last time a dosage was taken or when the next dosage should be taken from the dispenser 10. The sliding marker 62 includes a grooved rail 64 and an indicator 66 formed to slide along the rail 64. FIG. 7 specifically shows the days of the week, but any type of calendar or time display system could be employed on the medicine dispenser 10. All the parts of the medicine dispenser 10 could be made from clear or transparent materials. The transparent materials would allow the user to see the process of dispensing a pill. The pill cavities 46, delivery tube 26, delivery opening 32 and exit window 54 could be sized to accept more than one pill 34. This would allow a specific dosage to be dispensed at one time by the user. Further, the medicine dispenser 10 could be used for products other than medicines.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A dispenser for objects comprising:

an open ended container;

said container including a continuous wall having an open top end and an open bottom end;

a delivery opening as part of said wall and located near said bottom end;

a sealing cap rotatively fixed to and enclosing said top end;

a delivery cap rotatively fixed to and enclosing said bottom end;

an exit window as part of said delivery cap, said exit window radially aligning with said delivery opening by rotating said delivery cap on said container;

a floor inside said container near said bottom end to prevent said objects inside said container from passing into said delivery cap; and a delivery tube inside said container between said sealing cap and delivery cap, said tube protruding through said floor.

2. The dispenser as claimed in claim 1, further including a cap retaining means to rotatively retain said sealing and delivery caps to said container.

3. The dispenser as claimed in claim 1, wherein said tube is attached to an inside wall of said container.

4. The dispenser as claimed in claim 1, wherein said container and said tube are each an open ended cylinder.

5. The dispenser as claimed in claim 1, wherein said objects are pills.

6. The dispenser as claimed in claim 1, further including a sliding marker to indicate when a dosage was taken, said indicator including a grooved rail and an indicator which slides along said grooved rail.

7. The dispenser as claimed in claim 1, further including a sealing collar on an outside surface of the container wall near said top end; a sealing collar on said outside surface of the container wall near said bottom end; and a sealing flange on each of said caps that engages said sealing collars in order to retain said caps to the container ends.

8. The dispenser as claimed in claim 7, wherein said sealing flange runs along an edge of said outside flange that is opposite to said top.

9. The dispenser as claimed in claim 7, wherein each of said sealing collars extend outward from the container wall and wherein each of said sealing flanges extends inward toward said sealing collars from said caps.

10. The dispenser as claimed in claim 9, wherein said sealing flange includes a sloping leg to reduce the difficulty of sliding said sealing flange over said sealing collar.

11. The dispenser as claimed in claim 1, wherein said delivery and sealing caps each include a top, an outside flange extending downward from said top and a cavity to receive at least one of said objects in the container, said cavity being confined within said top and outside flange.

12. The dispenser as claimed in claim 11, wherein each of said cavities can be aligned with said delivery tube when said caps are rotated on the container, so that said objects can be exchanged between said cavities using said tube.

13. The dispenser as claimed in claim 11, wherein said exit window is an opening in said outside flange.

14. The dispenser as claimed in claim 11, further including indicators on outside surfaces of said caps and said container to indicate the position of said cavities and said tube.

15. The dispenser as claimed in claim 11, wherein said delivery and sealing caps include a sealing center extending downward from said cap top and within the confines of said outside flange and wherein said cavity is part of said sealing center.

16. The dispenser as claimed in claim 15, wherein said outside flange and said sealing center forms a gap in which each of said container open ends ride in when said caps are fixed to said container.

17. A method of dispensing objects using a dispenser comprising the steps of:

a. inverting the dispenser so that a top end of the dispenser with a sealing cap is lower than a bottom end of the dispenser with a delivery cap;

b. rotating the sealing cap so that at least one pill is captured by a cavity of the sealing cap;

c. rotating the sealing cap so the cavity of the sealing cap is aligned with a delivery tube;

d. inverting the dispenser, so that the bottom end is lower than the top end, where the inverting motion of this step allows the object to fall along the delivery tube toward the delivery cap due to gravity;

e. rotating the delivery cap to align a cavity of the delivery cap with the delivery tube, where the object is allowed to fall into the cavity of the delivery cap;

f. rotating and aligning the cavity of the delivery cap and hence an exit window of the delivery cap with a delivery opening in a wall of the dispenser; and g. tilting the dispenser so that the object in the cavity of the delivery cap passes through the exit window by way of the delivery opening.

18. The method as claimed in claim 17, wherein said objects are pills.

19. The method of claim 17, further including using a indicator on the sealing and delivery caps to mark the location of the cavities of each cap; using an indicator on the container to mark the location of the delivery tube; and using the indicators on the caps with the indicator on the container to align the cavities with the delivery tube.

* * * * *